United States Patent [19]

Takigawa et al.

[11] Patent Number: 4,709,480

[45] Date of Patent: Dec. 1, 1987

[54] SCISSORS

[75] Inventors: Shigetsugu Takigawa; Masuhiko Takigawa, both of Osaka, Japan

[73] Assignee: ARS Edge Co. Ltd., Osaka, Japan

[21] Appl. No.: 828,913

[22] Filed: Feb. 13, 1986

[30] Foreign Application Priority Data

Apr. 2, 1985 [JP] Japan ..... 60-49723[U]

[51] Int. Cl.[4] ..... B26B 13/10

[52] U.S. Cl. ..... 30/254; 30/315; 30/357

[58] Field of Search ..... 30/254, 350, 345, 357, 30/244; 76/104, DIG. 7

[56] References Cited

U.S. PATENT DOCUMENTS

| | | | |
|---|---|---|---|
| 636,473 | 11/1899 | Thuillier | 30/254 |
| 693,575 | 2/1902 | Thuillier | 30/254 |
| 2,579,773 | 12/1951 | Williams | 30/254 |
| 2,685,735 | 8/1954 | Sorensen | 30/230 |
| 3,931,672 | 1/1976 | Siden | 30/345 X |
| 4,422,240 | 12/1983 | Wallace et al. | 30/357 X |
| 4,592,141 | 6/1986 | Levine | 30/350 R |

FOREIGN PATENT DOCUMENTS

| | | | |
|---|---|---|---|
| 2244361 | 7/1973 | Fed. Rep. of Germany | 30/254 |
| 3344863 | 7/1984 | Fed. Rep. of Germany | 30/254 |
| 56-104450 | 8/1981 | Japan . | |
| 59-90762 | 6/1984 | Japan . | |

*Primary Examiner*—Paul A. Bell
*Assistant Examiner*—Willmon Fridie, Jr.
*Attorney, Agent, or Firm*—Griffin, Branigan, & Butler

[57] ABSTRACT

Scissors, wherein one of the two blades is made of a metal, while at least the cutting edge portion of the other blade is made of a ceramic. The cutting edge of the metallic blade has an acute included angle, while the flat side and its adjacent side of the ceramic blade form an obtuse included angle.

1 Claim, 5 Drawing Figures

SCISSORS

BACKGROUND OF THE INVENTION

The present invention relates broadly to improved scissors as used in horticulture and for industrial purposes, and more specifically to improved scissors having two blades, one of which is metallic while the other is ceramic.

Because ceramics have various excellent characteristics as compared with metals, and because of rapid progress made in recent years in the technique for working ceramics, it has been proposed to use ceramics instead of steel as a material for scissors as described in the Japanese laid-open utility model application No. 56-104450 and others.

The trouble is that ceramics are less tenacious than metals, although they have extra-high abrasion resistance. Low mechanical strength resulting therefrom causes the two blades of scissors to be liable to chip when both of them are made of ceramics. Once they have chipped, it is difficult to recondition them.

FIG. 3 illustrates a pair of scissors previously proposed by the present inventor in the form of the Japanese laid-open utility model application No. 59-90762 as an attempt to solve the above problem. The basic principle of this attempt resides in that the above-described disadvantage will be eliminated if one of the two blades of scissors is made of a ceramic which obviates the necessity of grinding and the other is made of a metal which can be easily ground. An important feature of the scissors shown in FIG. 3 is that the cutting edge of a metallic blade 1 has an acute included angle while the cutting edge of a ceramic blade 2 has an included angle larger than that of the metallic blade 1 and smaller than a right angle.

Normally, the flat sides of the blades 1 and 2 lie on a virtual plane AB (FIG. 3), and the beveled sides of these blades are disposed opposite to each other across the virtual plane AB. However, when the cutting edges cut into an article C, the article C splitting ahead of the cutting edges tends to react upon the cutting edges so as to allow them to trespass on the opposite sides of the virtual plane AB as shown with arrows in FIG. 3.

The blades 1 and 2 have a rivet or screw connection 3 (FIG. 4) between the cutting ends P and the handle ends. The two blades are made to twist or curve slightly toward one another so that they touch in only two places, i.e., at a point Q just behind the pivot 3 and at a point P′ (FIG. 5) along the blades where the cutting is taking place. When the blades 1 and 2 are completely closed, they are in touch with each other only at the points P and Q, with a gap S (FIG. 4) left between the middle portions of the blades 1 and 2. Because of their elasticity, the blades 1 and 2 apply contact pressure to each other while they are being closed. As they are closed, the contact point P′ shifts from right to left as viewed on FIG. 5. The blades 1 and 2 cross each other when the contact point P′ is midway between the pivot 3 and the cutting ends P.

Thus the scissors shown in FIG. 3 also have the disadvantage that the ceramic blade 2 is liable to chip when a hard article C is cut in the middle portions of the blades 1 and 2, because the left-hand halves of the blades 1 and 2 as viewed on FIG. 5 interfere with each other as they are closed.

SUMMARY OF THE INVENTION

It is therefore an object of the present invention to provide scissors, one of the two blades of which is made of a metal and at least the cutting edge portion of the other blade is made of a ceramic, characterized in that the cutting edge of the metallic blade has an acute included angle while the flat side and its adjacent side of the ceramic blade form an obtuse included angle so as to eliminate the possibility that the two blades may interfere with each other when they meet and thereby damage may be done to the ceramic blade by the metallic blade.

Like conventional scissors, the scissors in accordance with the present invention consist of a pair of pivoted blades adapted to meet and cut an article, the article being supported by a cutting edge formed by the beveled side and the above-mentioned adjacent side of the ceramic blade. The acute-angled cutting edge of the metallic blade is allowed to cut into the article from above along a virtual plane formed by the flat sides of the two blades. When the two blades meet, the flat side of one blade rubs against the flat side of the other blade. Then the article is cut in two by the shearing force of the two blades.

Since the flat side and its adjacent side of the ceramic blade form an obtuse included angle, the ceramic blade is prevented from a tendency of trespassing on the opposite side of the above-mentioned plane. Consequently, there is no chance that the cutting edges of the two blades will interfere with each other when they meet and thereby damage will be done to the cutting edge of the ceramic blade by that of the metallic blade.

A preferred embodiment of the present invention is hereinafter described with reference to the accompanying drawings.

DETAILED DESCRIPTION OF THE INVENTION

Figure 1:
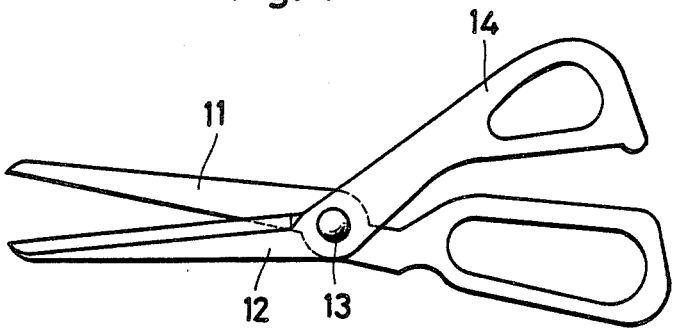
FIG. 1 is a front view of an embodiment of the present invention.
Figure 2:
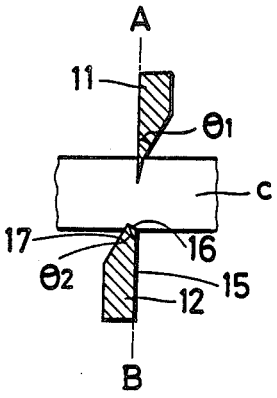
FIG. 2 is an enlarged sectional view of the main part thereof.
Figure 3:
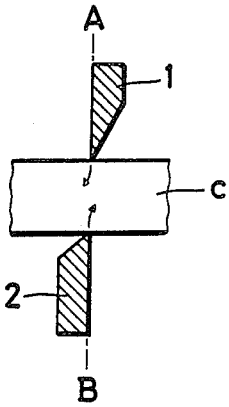
FIG. 3 is a sectional view of conventional scissors, showing schematically the directions of movement of cutting edges in severing an article.
Figure 4:
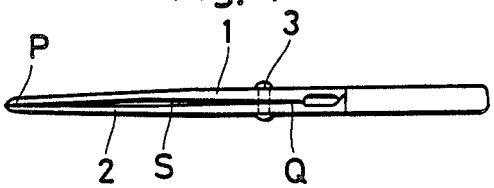
FIG. 4 is a plan view thereof, wherein the two blades are completely closed.
Figure 5:
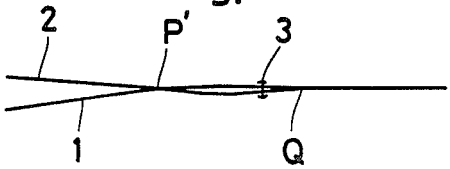
FIG. 5 is a schematic plan view thereof, wherein the two blades touch in two places, i.e., at a point just behind the pivot and at a point along the blades where the cutting is taking place.

Referring now to FIGS. 1 and 2, the scissors in accordance with the present invention include blades 11 and 12 adapted to move about their common pivot 13 when handles 14 at their ends are brought together or moved away from each other. The blade 11 is made of a metal which falls under thr iron family, while the whole or at least the cutting edge portion of the blade 12 is made of a ceramic. The flat side and the beveled side of the metallic blade 11 form an acute included angle $\theta_1$, while the flat side 15 and its adjacent side 16 of the ceramic blade 12 form an obtuse included angle $\theta_2$, the cutting edge of the blade 12 being formed by the adjacent side 16 and a beveled side 17.

Any type of ceramic will do, so long as it is made from a super hard, wear resisting mineral or minerals such as alumina, silicon carbide, silicon nitride or zirconia. Preferably, the acute included angle $\theta_1$ should fall with the range between 10° and 25°, while the obtuse included angle $\theta_2$ should fall within the range between 95° and 120°. In selecting the actual values of $\theta_1$ and $\theta_2$ from within these ranges, the quality of a ceramic which is going to be used as well as the kind and hardness of an article C to be cut by the scissors should be taken into consideration.

In operation, the blades 11 and 12 are opened, and the article C is supported by the cutting edge of the blade 12 formed by the adjacent side 16 and the beveled side 17. Then the acute-angled cutting edge of the blade 11 is allowed to cut into the article C from above along a virtual plane AB formed by the flat sides of the two blades 11 and 12. The article C splits ahead of the cutting edge of the blade 11 and is cut in two by the shearing force of the two blades 11 and 12.

Since the flat side 15 and its adjacent side 16 of the blade 12 form an obtuse included angle $\theta_2$, the cutting edges of the two blades 11 and 12 are prevented form interfering with each other when they meet. Consequently, there is no chance that damage will be done to the cutting edge of the ceramic blade 12 by that of the metallic blade 11.

The scissors in accordance with the present invention has another advantage that the metallic blade 11 is spontaneously ground when the two blades 11 and 12 meet, because the flat side of the metallic blade 11 rubs against the flat side 15 of the hard ceramic blade 12. Consequently, the scissors in accordance with the present invention remain sharp over a long period of time.

What is claimed is:

1. Scissors, comprising:

a first blade made of a metal and having a cutting edge formed by a flat side and beveled side intersecting at an acute included angle;

a second blade having a flat side adapted to rub against said flat side of said first blade when said first blade and said second blade meet;

said second blade further having an adjacent side to said flat side such that said adjacent side and said flat side form an obtuse included angle;

said second blade further having a beveled side intersecting said adjacent side at an angle and thereby forming a non-jagged sharp line cutting edge portion, at least said cutting edge portion being made of a ceramic; and a pivot for permitting the pivotal movement of said first blade and said second blade when handles at their ends are brought together or moved away from each other.

* * * * *

UNITED STATES PATENT AND TRADEMARK OFFICE

CERTIFICATE OF CORRECTION

PATENT NO. : 4,709,480
DATED : December 1, 1987
INVENTOR(S) : Richard A. Allen

It is certified that error appears in the above-identified patent and that said Letters Patent is hereby corrected as shown below:

Title page,
Item * Notice replace "The entire wording in the Notice" with -- This patent is subject to a terminal disclaimer. --.

Signed and Sealed this

Second Day of October, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 4,709,480
DATED : December 1, 1987
INVENTOR(S) : Takigawa et al.

It is certified that error appears in the above-identified patent and that said Letters Patent is hereby corrected as shown below:

This certificate supercedes Certificate of Correction issued October 2, 2001, the number was erroneously mentioned and should be vacated since no Certificate of Correction was granted.

Signed and Sealed this

Fifteenth Day of April, 2003

JAMES E. ROGAN
*Director of the United States Patent and Trademark Office*